United States Patent [19]

Alsenz

[11] Patent Number: 4,531,376

[45] Date of Patent: Jul. 30, 1985

[54] REFRIGERATOR DEFROST CONTROL

[76] Inventor: Richard H. Alsenz, 2402 Creek Meadows Dr., Missouri City, Tex. 77459

[21] Appl. No.: 417,561

[22] PCT Filed: Jun. 26, 1981

[86] PCT No.: PCT/US81/00881

§ 371 Date: Aug. 27, 1982

§ 102(e) Date: Aug. 27, 1982

[87] PCT Pub. No.: WO83/00211

PCT Pub. Date: Jan. 20, 1983

[51] Int. Cl.[3] ..... F25D 21/02; F25D 21/06

[52] U.S. Cl. ..... 62/156; 62/140; 62/155

[58] Field of Search ..... 62/156, 155, 140, 128, 62/151, 154, 80; 315/200 A

[56] References Cited

U.S. PATENT DOCUMENTS

| | | | |
|---|---|---|---|
| 2,849,617 | 8/1958 | Karasek | 250/43.5 |
| 2,866,900 | 12/1958 | Busignies et al. | 250/43.5 |
| 3,120,108 | 2/1964 | Pansing | 62/126 |
| 3,138,006 | 6/1964 | Moorman et al. | 62/156 |
| 3,188,828 | 6/1965 | Wayne | 62/140 |
| 3,585,483 | 6/1971 | Skirvin | 315/200 A |
| 3,588,496 | 6/1971 | Snowman | 250/43.5 |
| 3,737,731 | 6/1973 | Zeewy | 315/200 A |
| 3,946,286 | 3/1976 | Kinnunen et al. | 340/234 X |
| 3,961,495 | 6/1976 | Beauvent et al. | 62/140 |
| 4,109,481 | 8/1978 | Peek | 62/151 |
| 4,299,095 | 11/1981 | Cassarino | 62/155 |

OTHER PUBLICATIONS

Optical Methods in Ultracontrifugation, Electrophoresis and Diffusion, Lloyd, Jul. 1972.

*Primary Examiner*—Harry B. Tanner

*Attorney, Agent, or Firm*—Arnold, White & Durkee

[57] ABSTRACT

In one exemplar embodiment, an improved evaporating coil defrost control (28) for use in a refrigeration system is disclosed, and which includes a pair of thermostatically controlled switch contacts (42, 44) positioned adjacent the evaporator coil (14) and responsive to the temperature of the coil, the contacts being heated by a resistor or thermister heater (46) to maintain the temperature of the contacts above a predetermined "low" temperature level. The refrigerator compressor (18) is operated through one of the normally closed switch contacts (42) when the switch (40) is maintained above the "low" temperature level. A defrost initiation means (48) de-energizes the heater (46) when defrost is necessary, permitting the thermostatically controlled switch contacts (42, 44) to cool below the "low" temperature level and closing the normally open switch contact (44) to actuate a defrost means (26) to defrost the evaporator coil (14). The defrost means (26) heats the evaporator coil (14) until the melting point of the frost or ice is reached to remove frost and ice, and in turn heats the switch contacts (42, 44) until a predetermined "high" temperature level is reached for changing the state of the switch (40) and re-energizing the compressor (18), cooling the evaporator coil (14), and de-energizing the defrost means (26). The resistor or thermistor heat (46) is re-energized to maintain the temperature of the thermostatically controlled switch contacts (42, 44) above the "low" temperature.

28 Claims, 6 Drawing Figures

REFRIGERATOR DEFROST CONTROL

TECHNICAL FIELD

This invention relates to an evaporating coil defrost control for various types of refrigeration apparatus and more particularly to an automatic defrost system for refrigeration apparatus that will provide a positive termination control for the defrost cycle. In addition, the invention provides a low cost means for interfacing with present solid state defrost initiation devices.

The invention provides an inherent positive and "fail-safe" means for terminating the defrost cycle that is independent of the means for initiating the defrost cycle and meets all of the present safety requirements of the refrigeration industry.

BACKGROUND ART

The representative prior art for refrigeration defrost control is disclosed in the following U.S. Patents: U.S. Pat. Nos. 3,899,895 (Blanton et al); 3,839,878 (Tilmanis); 3,826,103 (Grover); 3,759,049 (Bell et al); 3,726,105 (Auracher); 3,626,707 (Bauknecht et al); 3,525,222 (Schuller); 3,518,841 (West, Jr.); 3,492,832 (Davis et al); 3,436,929 (Harbour); 3,373,575 (Nelson); 3,228,204 (Matthies); 3,203,195 (Armentrout); 3,174,297 (Kuhn et al); 3,138,006 (Moorman et al); 3,134,238 (Matthies); 3,105,364 (O'Connell); 3,055,188 (Syfert); 2,949,017 (Swanson); 2,907,180 (Mann); 2,866,323 (Candor); and 2,765,630 (Shaw).

The patent to Moorman, et al (U.S. Pat. No. 3,138,006) discloses a defrost control arrangement for a two compartment refrigerator, one compartment generally operating below-freezing and the other operating at above-freezing temperatures. Warmer humid air is drawn from the above-freezing compartment to the below-freezing compartment and directed over the evaporator to cool and remove moisture from the warm humid air. The cooled air is directed downwardly by a fan to the above-freezing compartment through a passageway, the airflow through which is controlled by a thermostatically controlled air valve. The defrost control includes a snap-acting, double-throw, bimetal, thermostatic switch that is mounted upon the edges of the fins of the evaporator at the point where the warm humid air from the above-freezing compartment enters the evaporator chamber and is responsive to the temperature of the warmer air flowing from the above-freezing compartment and the temperature of the evaporator surface.

The switch has first and second contacts which are alternately energized upon a rise in temperature to about 55° F. and to a fall in temperature to about 28° F. when the switch has frost formed about its outer surface. The refrigerating system is connected to the energy supply upon the rise in temperature of the switch to 55° F. and remains connected until the temperature of the switch falls to 28° F. and is frosted. When the temperature falls to 28° F. the defrost system is connected to the energy supply for defrosting the evaporator. When the thermostat switch is free of frost, it is warmed by the relatively warm air from the above-freezing compartment, thus preventing the thermostat from falling to the low defrost temperature. After frost accumulates on the thermostat and the evaporator, the rate of air flow is reduced and the thermostat is shielded from the warmer air from the above-freezing compartment by the frost covering on the thermostat. This shielding action by the frost lowers the temperature of the thermostat. To prevent unnecessary defrosting by the thermostat because of temperature variations, a small electric heater is provided that is in heat transfer with the thermostat and normally energized to compensate for such temperature variations.

When the above-freezing compartment rises to an abnormally high temperature, the air valve will move to an abnormally wide-open position and opens a switch contact in series with the thermostat heater, permitting the thermostat to cool if the thermostat has sufficiently frosted over to lower the temperature below 28° F. The thermostat will snap to the defrost position and energizes a defrost heater to melt the frost from the evaporator. The thermostat heater is also controlled by a temperature responsive resistor responsive to ambient temperatures.

The above prior art defrost control utilizes as a defrost initiation device the cooperative temperature responsive activity of the air-valve (responsive to temperature in the above-freezing compartment) and the frosting of the thermostatic switch in physical contact with the evaporator. The thermostat heater power is controlled by temperature responsive resistances responsive to ambient temperatures to vary the need for defrost and the defrost period. Such control results in a further cooperative temperature response to initiate defrost action. One major disadvantage is that the thermostat must be placed in a location where it can be sufficiently frosted to shield the thermostat from the high-temperature compartment air for initiating the defrost cycle. The ideal location for a defrost cycle termination thermostat would be in an area where the evaporator coil compartment is coldest, which would dictate a location other than that for the placement of the thermostat for initiating the defrost cycle. However, since the thermostatic switch serves a dual purpose (termination and initiation) the actual location for responding to the high temperature compartment air is not the desirable loation for terminating the defrost. Because of the extremely specialized nature of the above control, it never met with commercial acceptance in the marketplace.

The other patents disclose defrost controls that operate in response to differentials in temperature of the evaporator coil and the refrigerated space; in response to clock timers and humidity sensors; in response to heating the evaporator coil using heated refrigerant; or in response to other mechanical switch devices.

DISCLOSURE OF INVENTION

The present invention remedies the problems of the prior art by providing an improved defrost control for refrigeration apparatus that provides a positive termination control for the defrost cycle. In addition, the present invention provides a low cost means for interfacing with other solid state defrost initiation devices and provides a safety means for controlling the refrigeration system in the event of failure of the selected initiation device.

The present invention provides a defrost initiating means that is completely independent of absolute temperature of any refrigerated space. A defrost terminating means, which can conveniently be a thermostatic switch, functions to terminate the defrost action and is responsive to the temperature of the evaporator. A heating means is provided to prevent the defrost terminating means from cooling to a selected low temperature and is de-energized by the defrost initiating device when a defrost is required. The thermostatic switch functions only for terminating the defrost cycle and does not determine a requirement for defrost, which is the sole function of the defrost initiating device. The thermostat heater is used solely as an inhibiting device for the thermostat. The control is totally independent of absolute temperature in either an above-freezing compartment or a below-freezing compartment of the refrigeration system.

In the event the defrost initiation device initiates defrost and then fails, the thermostatic switch (defrost terminating means) will cycle between the established high and low temperature limits. The heated evaporator temperature will cause the thermostatic switch to change states for re-energizing the compressor motor for cooling, but when the thermostatic switch cools to the low temperature limit, it will change states again to cutoff the compressor motor. Such cycling action, even if the defrost initiation device fails, will prevent overheating of the product compartment and maintain the product compartment at a slightly higher temperature than normal, thus avoiding a complete loss of refrigerated product.

According to one principle of the invention, an improved evaporator defrost control for use in a refrigeration system including a compressor, a condenser, an evaporator and a defrost means is disclosed, comprising defrost initiating means operable independently of absolute temperature for requiring defrost of the evaporator, defrost terminating means positioned in a heat transfer relationship to the evaporator and responsive to the temperature thereof, the means responsive to a preselected high temperature for energizing the compressor for cooling the evaporator and terminating defrost. The defrost termination means is further responsive to a preselected low temperature for de-energizing the compressor and energizing the evaporator defrost means. The control further comprises heating means positioned in heat transfer proximity to the defrost terminating means and responsive to the defrost initiating means heating the defrost terminating means above the preselected low temperature for preventing the defrost terminating means from cooling to the low temperature, the heating means being de-energized by the defrost initiating means when a defrost is required for permitting the defrost terminating means to cool below the pre-selected low temperature level for energizing the evaporator defrost means and de-energizing the compressor. The evaporator defrost means heats the evaporator to a temperature above the pre-selected high temperature for causing the defrost terminating means to respond and re-energize the compressor and the heating means and de-energize the evaporator defrost means.

According to a further principle of the invention, the above described improved evaporator defrost control further includes a defrost terminating means comprising a thermostatically controlled switch having at least a pair of switch contacts, at least one of the switch contacts being in a normally closed condition when the switch is maintained above the low temperature level by the heating means for energizing the compressor, and at least one of the switch contacts being in a normally closed condition when the switch is operable in response to the low temperature for energizing the evaporator defrost means.

According to yet another principle of the invention, the above described evaporator defrost control further includes a defrost initiating means operable independently of absolute temperature and including an optical sensing device, or a timing device, or a velocity sensing device or any combination thereof.

Accordingly, one primary feature of the present invention is to provide an improved apparatus for defrost initiation and termination in a refrigeration system utilizing a defrost initiating means that is independent of absolute temperature.

Another feature of the present invention is to provide a refrigeration system defrost control that is independent of the temperature in the above-freezing compartment of the refrigeration system.

Still another feature of the present invention is to provide a temperature responsive means responsive to the evaporator temperature as a positive defrost terminating device.

Yet another feature of the present invention is to provide a simple low cost switching apparatus for interfacing with solid state defrost initiation devices.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings.

BEST MODE FOR CARRYING OUT THE INVENTION

Figure 1:
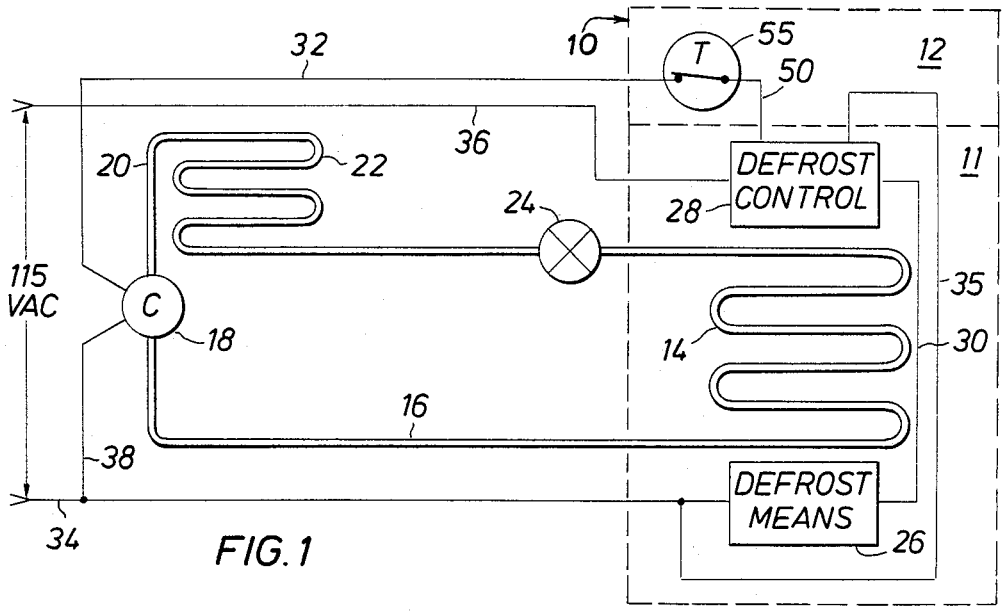
FIG. 1 is a schematic representation of a typical refrigeration apparatus utilizing the defrost control of this invention.

Referring now to FIG. 1, the refrigeration defrost system control is shown. A refrigerator (or freezer) 10 is shown having an inner refrigerated space 12 that is cooled in a conventional manner by evaporator (cooling) coils 14 within an evaporator compartment 11 of a conventional closed refrigeration system. The refrigeration system comprises a compressor 18 connected to the evaporator 14 by means of suction line 16 for receiving the refrigeration fluid in a gaseous form, compressing the fluid and distributing it through line 20 to the condenser 22 where the refrigeration fluid condensed to a liquid. The liquid refrigeration fluid is then applied through an expansion valve 24 to the evaporator 14 in compartment 11 for cooling the refrigerated space 12.

An evaporator defrost means 26, typically an electrical defrost heater, is provided to defrost the evaporator 14 when the accumulation of ice or frost needs to be removed from the evaporator surface to increase the heat exchange efficiency of the evaporator. AC electrical power for the system is provided by conductors 34 and 36. Line 34 and 38 are connected to compressor 18, with line 34 connected directly to defrost means 26. Line 36 is connected to the defrost control 28 according to this invention to control defrost and the operation of compressor 18. The defrost control 28 controls the operation of the defrost means 26 through conductor 30. The defrost control 28 also controls operation of compressor 18 through conductors 32 and 50 and a low temperature thermostat switch 55 AC power is also applied through conductors 34 and 35 to circuit 28.

While the above description of the refrigerating system 10 has been explained in terms of a refrigerator or freezer, the refrigerating system 10 could be any refrigerating means such as an air conditioning system or the refrigerating phase of a heat pump system. Further, the evaporator defrost means 26, while described in terms of a conventional electrical heater coil, can be any suitable means for defrosting an evaporator surface, including reversing refrigerant flow through the evaporator to enable the hot refrigerant to warm and defrost the evaporator.

Figure 2:
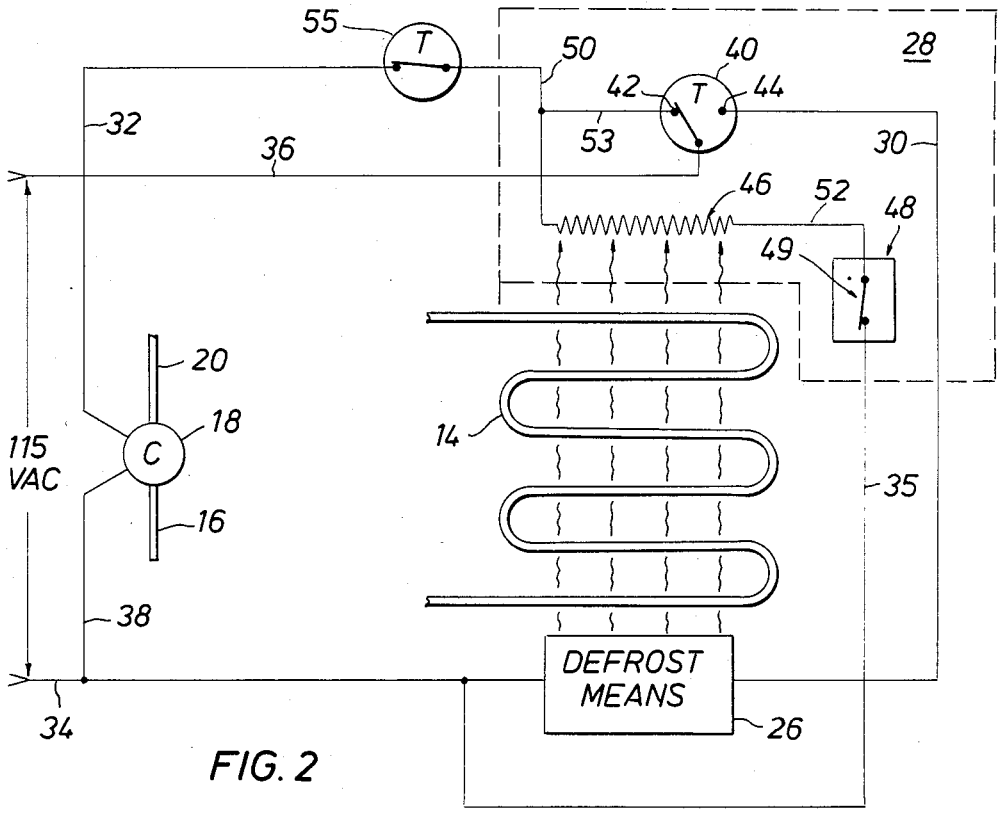
FIG. 2 is an electrical schematic of the defrost control according to this invention.

FIG. 2 shows the defrost termination control 28 in greater detail. A single-pole, double throw thermostat 40, a heating element 46 and a defrost initiation means 48 comprise control 28. The defrost initiation means 48 may be any defrost initiation device that is operable independent of the absolute temperatures of any temperature compartments of the refrigeration system (such as compartments 11 or 12—see FIG. 1), such as an optical frost sensing device, time clock, or air velocity sensing device, or any combination of these devices, any of which may initiate defrost action either upon demand or at preset intervals. The thermostat 40 can be any conventional single pole, double-throw type thermostatic switch, such as a bimetallic type thermostat, and includes at least one normally closed switch contact 42 and at least one normally open switch contact 44. Thermostatic switch 40 is positioned in a heat transfer relationship to the evaporator 14 and is responsive to the temperature thereof.

An AC input power line 36 is connected to the input terminal of thermostatic switching means 40. The normally open contact 44 is connected by conductor 30 to the evaporator defrost means 26. The normally closed contact 42 is connected by conductors 53 and 50 through thermostat switch 55 and line 32 to the compressor 18, and through conductors 53 and 50 to a heating means 46 which is series connected with the defrost initiation means 48 by conductor 52. Heating means 46 may conveniently be a resistive heating coil or a thermistor or any other suitable heating means. The other side of defrost initiation means 48 is connected to the AC power source line 34 by conductor 35. The heating means 46 is positioned in a heat transfer relationship to thermostat 40 to heat the thermostat for reasons that will be further described. The thermal switch or thermostat 55, which is normally located in the refrigeration compartment 12, opens when the temperature in space 12 reaches a predetermined low temperature for de-energizing compressor 18.

In operation, assuming thermostat 40 is maintained above its "low" temperature or "refrigeration" mode, which may conveniently be selected as 50° F., by the operation of heating means 46, as shown in FIG. 2, contacts 42 are closed and contacts 44 are open. Therefore, the defrost means 26 is disabled and the compressor 18 is operating by virtue of AC power applied through line 36, thermostatic switch contact 42, thermostat 55, and line 32. Current is also applied through heater 46 by conductors 50 and 52 through the defrost initiating means 48 normally closed switching means 49, and conductor 35. Maintaining the thermostat 40 above the "low" temperature mode continues the operation of the compressor 18 to cool the refrigerated space 12.

When the defrost initiation means 48 determines that a defrost of evaporator 14 is necessary, (depending on the type of defrost initiation device utilized), normally closed switching means 49 is opened, thus opening the circuit between lines 52 and 35 and interrupting the current through heater 46. Without heater 46, thermostat 40, which is positioned in a heat transfer relationship to the evaporator coil 14, begins to cool rapidly below the preselected "low" temperature (for example, say 50° F.) since thermostat 40 is responsive to the evaporator temperature. Thermostat 40 is then actuated to close contacts 44 to apply electrical power to the defrost means 26 (typically a defrost heater) for defrosting evaporator 14, and to open contacts 42 to interrupt the operation of compressor 18 during the "defrost" mode or state. The thermostat 40 remains in this "low" temperature mode during defrost until the temperature of the evaporator coil 14 during defrost rises to a preselected "high" temperature (for example, 55° F., which is selected above the melting point of ice or frost on the evaporator surface) where thermostatic switch 40, responding to the evaporator temperature, is actuated to a "high" temperature mode, opening contacts 44 and positively terminating the defrost, and closing contacts 42 to restart the compressor 18.

The positive recycling of thermostatically controlled switch 40 from its "low" to "high" temperature state will also occur because of the action of the heat from defrost means 26 heating the evaporator and thermostat 40 above its "high" switching level. When thermostat 40 recycles to its "high" state, thus closing switch contacts 42 and opening switch contacts 44, and defrost initiation control 48 has reset during the defrost cycle to close switching means 49, electrical power from line 34 will again be applied to heater 46 through switch contact 42. The heating action of heater 46 will again inhibit thermostat 40 from falling to its "low" state by maintaining the temperature of thermostat 40 above the "low" temperature level until the defrost initiation control 48 again signals that a "defrost" is necessary.

As may be seen, defrost initiation by defrost initiating means 48 is completely independent of absolute temperature of any refrigerated space. Further, defrost initiating device 48 does not cooperate with or depend on the temperature of any other responsive means, such as the thermostat 40. Means 48 is the only means that can initiate defrost and will initiate a defrost sequence independent of the state of any other component in the control circuit.

Defrost termination responsive to the heating action of defrost means 26 and evaporator 14 recycles the thermostatically controlled switch 40 as above described, and will positively occur whether or not the defrost initiation means 48 has been reset or recycled for closing switch contacts 49 to complete the circuit to heater 46 through conductors 52 and 35. Accordingly, direct positive defrost termination can be achieved and controlled independent of the defrost initiating means 48 and without a necessity that thermostat 40 be frosted.

In conventional refrigerating and air conditioning systems, a "fail-safe" thermostat is required to be inserted in series with the defrost means 26 to insure that upon an "unacceptable" temperature rise in the refrigerator, (due to failure of the defrosting control device to discontinue defrost) the defrost means will be de-energized to discontinue the defrost cycle. However, the heating of thermostat 40 by defroster 26 to recycle thermostat 40, independent of the action of defrost initiation device 48, builds a "fail-safe" feature into the present invention, since thermostat 40 will be recycled completely independent of the operation of device 48 in order to positively terminate defrost.

In the event the defrost initiation device 48 initiates defrost and then fails, the thermostatic switch (defrost terminating means) 40 will cycle between the established "high" and "low" temperature limits. The heated evaporator 14 temperature will cause the thermostatic switch 40 to change states for re-energizing the compressor motor 18 for cooling, but when the thermostatic switch 40 cools to the "low" temperature limit, it will change states again to cutoff the compressor motor 18. Such cycling action, even if the defrost initiation means 48 fails, will prevent overheating of the product compartment 12 and maintain the product compartment at a slightly higher temperature than normal, thus avoiding a complete loss of refrigerated product.

Figure 3:
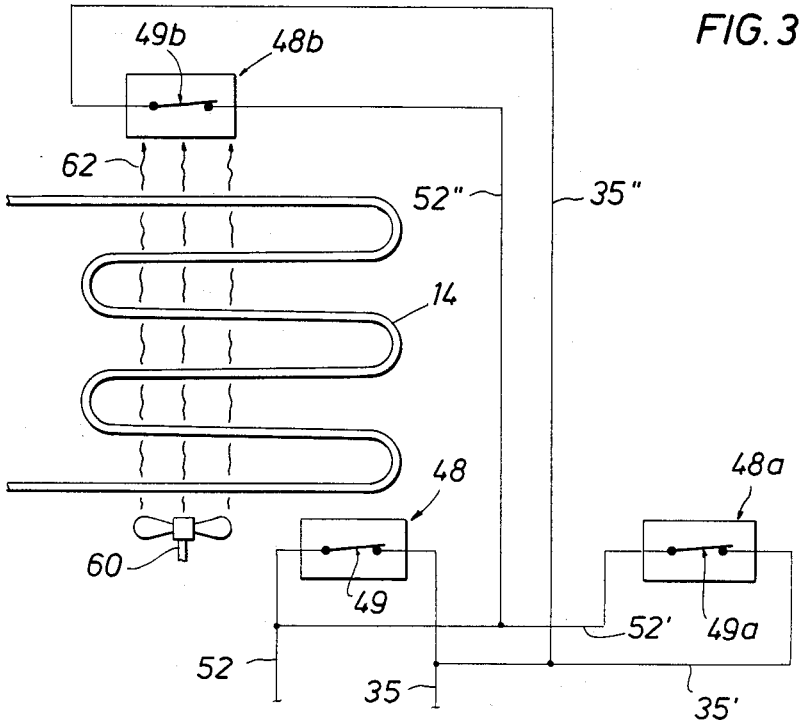
FIG. 3 is a schematic representation showing placement of conventional defrost initiating devices and the combination of two or more such devices.

FIG. 3 illustrates positioning of various defrost initiation devices 48 earlier mentioned. An optical defrost sensing device 48 would be mounted on or closely adjacent the surface of evaporator 14 as shown. A clock timing device **48*a* could of course, be located anywhere in the system. An air velocity sensing device 48*b* senses changes in air velocity through the evaporator 14, the air flow 62 being provided by a fan device, or other air moving means, shown schematically at 60**. Of course, more than one such device can be combined together for enhanced reliability and efficiency.

As an example, optical sensing device 48 and the timing device **48*a* could be combined as a single frost initiating device. The normally closed switching means 49 and 49*a* of devices 48 and 48*a* could be connected in parallel by means of conductors 52 and 52' and 35 and 35' as shown in FIG. 3. In such an arrangement, both devices 48 and 48*a* would have to be actuated to signal defrost initiation, thus enhancing the reliability of the defrost initiation system. Of course a velocity device 48*b* could be connected in parallel with optical device 48 or timing device 48*a* through conductors 52'' and 35''**.

Figure 4:
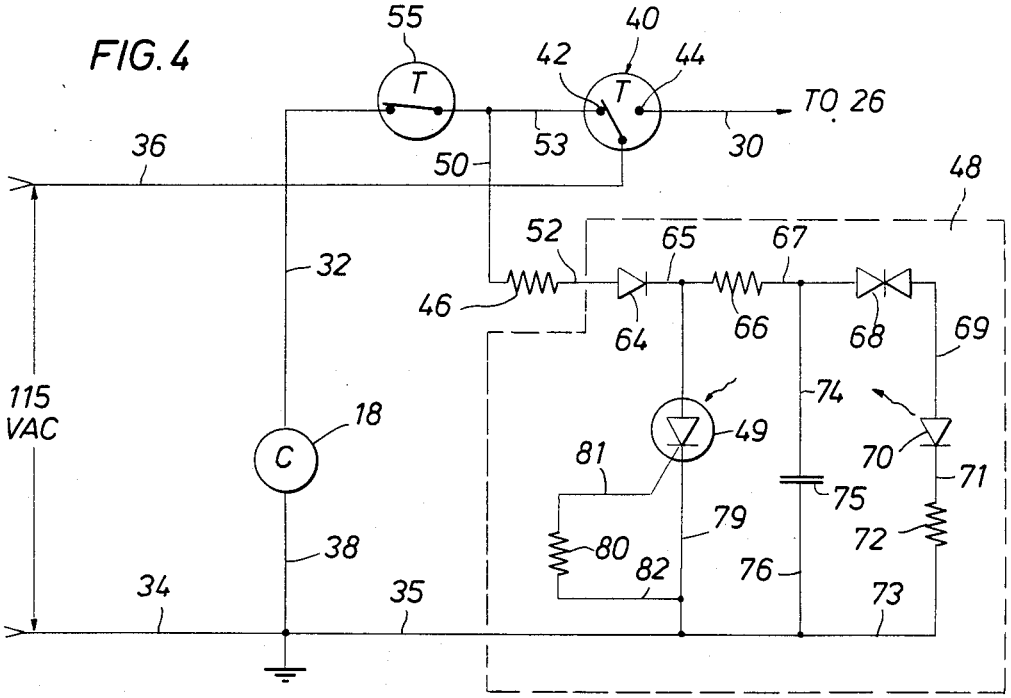
FIG. 4 is an electrical schematic of an embodiment of an optical defrost initiating circuit.

The optical frost sensing and initiation means 48 may conveniently be any conventional optical frost sensing device, such as the Model RA2-115 Frost Senzor manufactured and sold by Altech Controls Corporation. Another embodiment of such a solid-state optical frost sensing and initiation means 48 is disclosed in FIG. 4. A partial electrical schematic of the refrigerator is shown including the applicable portions of the control circuit shown in FIGS. 1 and 2, including a detailed schematic of the defrost initiation means 48. Compressor 18 is shown connected to the AC power source through conductors 34 and 38 on one side (ground potential) and on the other side through conductor 32, thermostatic switch 55, conductors 50 and 53, closed switch contact 42 and conductor 36. Heater 46 is connected on one side through conductors 50 and 53, thermostatic switch 40 closed contacts 42 and conductor 36 to the AC power source.

The other side of heater 46 is connected in series with diode 64, resistor 66, a DIAC 68, an LED 70 and resistor 72 to ground potential through interconnecting conductors 65, 67, 69, 71, 73, 35 and 34. A capacitor 75 is connected in parallel with DIAC 68, LED 70 and resistor 72 through conductors 74 and 76 interconnecting to conductors 67 an 73. A LASCR, acting as a switch means 49, is connected in parallel with resistor 66 and capacitor 75 by conductors 77 and 79 interconnecting to conductors 65 and 35. The trigger input of LASCR 49 is connected to a resistor 80 through conductors 81 and 82 connected to conductor 79. Resistor 80 determines the trigger or threshold voltage for turning on or off the LASCR 49.

In operation, the AC voltage is applied to the heater 46 through closed contacts 42 of thermostatic switch 40 and then to the anode of diode 64. The series paths through diode 64, resistor 66, and capacitor 75, or through diode 64, resistor 66, DIAC 68, LED 70 and resistor 72 are high resistance paths and a small current (on the order of microamps) is passed therethrough. Initially, the capacitor 75 slowly charges unitl it reaches a selected voltage level that causes reverse conduction of DIAC 68 (conveniently about 32 volts) which causes capacitor 75 to discharge and the LED 70 to conduct, thus generating electromagnetic radiation of preselected wavelengths that is directed toward the LASCR 49. However, as soon as capacitor 75 discharges, the DIAC 68 reverses, shutting off LED 70 and permitting capacitor 75 to begin charging again. Accordingly, it can be seen that LED 70 will be "turned on" at regular intervals determined by the RC time constant of resistor 66 and capacitor 75 acting as a pulse circuit means, and the LED will generate successive pulses or bursts of electromagnetic radiation directed toward the LASCR. The small current (microamps) passing through the high resistance paths is insufficient to cause any appreciable thermal heating of resistor 46.

If there is no ice or frost on coil 14 or if the ice or frost thickness is insufficient to scatter or absorb all of the pulses of electro-magnetic radiation generated by LED 70, then the electromagnetic radiation received by LASCR 49 will generate a voltage which, if it exceeds the threshold voltage determined by resistor 80, causes the LASCR to conduct. The series path through diode 64 and LASCR 49 is a low resistance path when the LASCR is conducting and, therefore, a large current will flow through heater 46, causing a substantial degree of thermal heating of resistor 46. However, during the interval when no electromagnetic radiation is received from LED 70, LASCR 49 stops conducting and capacitor 75 charges again to pulse LED 70 through DIAC 68. As long as LASCR 49 receives sufficient electromagnetic radiation from LED 70 to conduct, then LASCR 49 will act as a switch means to turn on heater 46 in successive bursts corresponding to the LED 70 pulses. Such bursts of large current through heater 46 are sufficient to cause thermal heating sufficient to maintain thermostatic switch 40 in its "high" temperature mode as hereinabove described, thereby disabling the defrost means 26.

However, when insufficient electromagnetic radiation reaches LASCR 49 to cause conduction, then the voltage at the diode 64 remains high. As previously described, the small current passing through diode 64 to the high resistance paths described is insufficient to cause any appreciable thermal heating by heater 46, and then thermostatic switch 40 cools rapidly to its "low" temperature mode or state, as hereinabove previously described, closing switch contacts 44 and energizing the heating means 26 for the defrosting operation hereinabove described. The defrost initiation device 48 shown in FIG. 4 discloses a simple, solid state optical frost sensing circuit for cooperating with the control to function as a reliable defrost initiation means.

Figure 5:
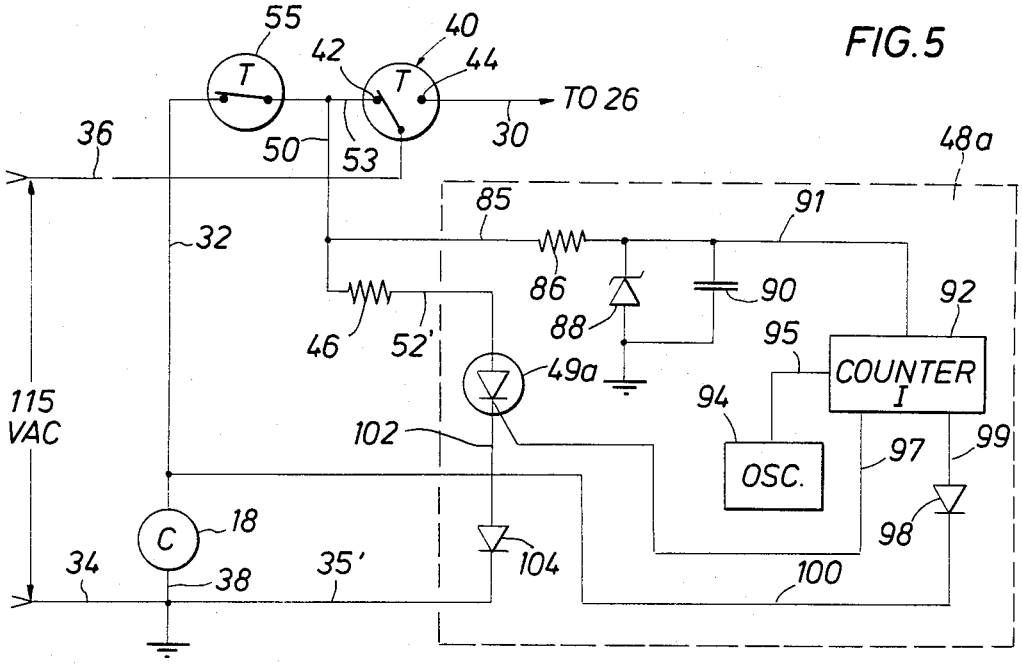
FIG. 5 is an electrical schematic of an embodiment of a defrost initiating timing circuit.

FIG. 5 discloses a preferred embodiment of a solid state defrost initiation timer 48*a*. The compressor 18 is connected to a source of AC power through thermostat 55 and thermostatic switch 40 as previously described for the optical device 48 shown in FIG. 4. One side of heater 46 is connected through conductors 50 and 53 to AC power through the closed switch contact 42 of thermostatic switch 40. The other side of heater 46 is connected in series with an SCR 49*a*, functioning as a switching means 49 as hereinabove described, and a current limiting diode 104 to ground potential through interconnecting conductors 52', 102, 35' and 34. AC voltage is also applied through conductors 53, 50 and 85 to a DC rectifier circuit comprising resistor 86, Zener diode 88 and capacitor 90 to establish a DC +V source applied to a binary counter or timing means 92 through conductor 91. Conductor 93 interconnects counter 92 and the other sides of Zener diode 88 and capacitor 90 to the anode side of diode 104. An oscillator 94 applies it input to counter 92 through conductor 95 for driving the counter through its selected counting sequence. The counter output is applied through conductor 97 to the trigger input of SCR 49*a* for turning the switch means 49*a* on and off in a preselected time sequence. An inhibit input (I) of counter 92 is connected by conductors 99 and 100, and diode 98 to conductor 32 on one side of compressor 18.

In operation, the oscillator 94 applies its output through conductor 95 to counter or timing means 92 for driving the counter through its counting or timing sequence for forming a timing means for generating an output signal for a preselected time period. When the oscillator 94 applies trigger pulses to counter 92 and no inhibit (I) input is present, the output of counter 92 goes to a high voltage level. The high voltage level applied through conductor 97 turns on the SCR 49*a*. SCR 49*a* conducting, a large current flows through heater 46, conductor 52', SCR 49*a*, conductor 102, diode 104, and conductors 35' and 34 to ground. The large current through heater 46 will be sufficient to cause thermal heating of thermostatic switch 40 to maintain the switch in the "high" temperature state or mode. As long as SCR 49*a* conducts, the heater 46 is turned on and heats the switch 40. However, when oscillator 94 has driven counter 92 through its full counting sequence, then the output of counter 92 goes to a low voltage level, causing SCR 49*a* to cease conducting, thereby turning off the heater 46 and permitting thermostatic switch 40 to cool to its "low" temperature state as previously described. Further, if compressor motor 18 is shut off by the action of thermostat 55 opening upon reaching a preselected low temperature, then the cathode of diode 98 will go to ground potential through compressor motor 18 and conductor 100 causing the diode 98 to conduct and inhibit counting by the counter 92. The diode 98 functions as an inhibiting means to inhibit the generating of an output signal by counter 92 when the compressor motor 18 is not operating.

Therefore, the counter 92 will only count or time while the compressor motor 18 is energized and running, i.e., only counts or times during compressor "run" time. If the counter 92 is set to count, for example, for a time period of eight (8) hours, the counter output applied to SCR 49*a* will be "high" during that eight (8)-hour time period and trigger the SCR to a conducting state and energizing the heater 46. However, if compressor 18 is turned off at the end of six (6) hours by the opening of thermostatic switch 55, then counter 92 is inhibited and stops its count at the end of six (6) hours. If the compressor motor 18 stays off for two (2) hours and then is turned back on due to the closing of thermostatic switch 55, counter 92 is not reset, but continues its count (i.e., has a high output to trigger SCR 49*a* to conduct, thus energizing heater 46) for the balance of the original interrupted eight, (8)-hour time period, i.e., two (2) additional hours, before the counter is reset and turns off SCR 49*a*. Thus the timer circuit 48*a* has maintained the heater 46 in an energized condition for a total of eight (8) hours of compressor run time although an actual ten (10)-hour time period has elapsed. The counter 92 will now remain in a reset condition for a preselected time period in order to allow thermostat 40 to cool to its "low" temperature condition for defrost as hereinabove described.

Figure 6:
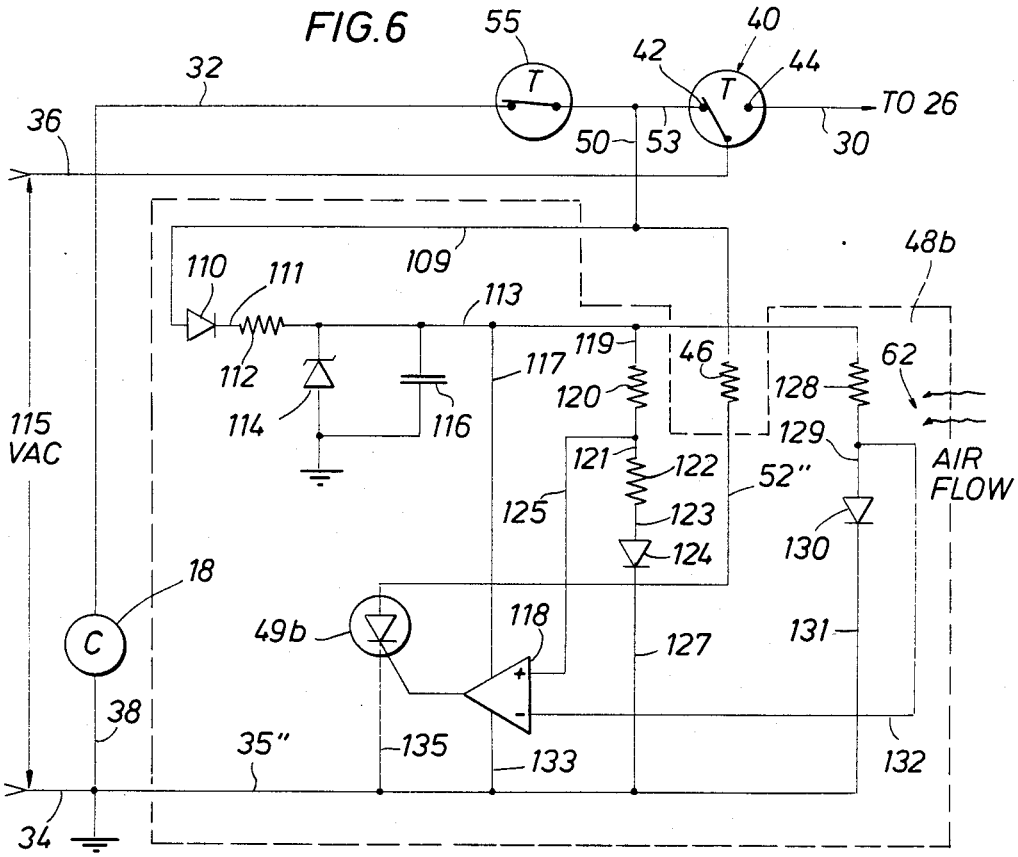
FIG. 6 is an electrical schematic of an embodiment of an air velocity defrost initiating circuit.

FIG. 6 shows one preferred embodiment of an air pressure sensing circuit for use as a defrost initiation device 49*b*. Compressor motor 18 is connected to a source of AC power applied through conductors 34 and 36 as hereinabove described. When thermostatic switch 40 is in its "high" temperature state as hereinabove described, AC power is applied through conductor 36, closed switch contact 42, and conductors 53 and 50 to heater coil 46. Heater coil 46 is connected in series with an SCR 49*b*, acting as a switching means 49, as previously described, through conductor 52". The cathode of SCR 49*b* is connected through conductors 135, 35" and 34 to ground potential. AC power is also applied through conductors 50 and 109 to a diode 110 and then through conductor 111 to a DC rectifier circuit comprising resistor 112, Zener diode 114 and capacitor 116. The DC output voltage is coupled through conductor 113 to resistor 128 and then through conductor 129 to diode 130. The cathode of diode 130 is connected to ground potential through conductors 131, 35" and 34. The DC voltage is also coupled through conductors 113 and 119 to series connected resistors 120 and 122 to the anode of diode 124 through interconnecting conductors 121 and 123. Conductors 127 and 131 interconnect the cathodes of diodes 124 and 130 to form a pair of spaced parallel legs comprising resistors 120 and 122 and diode 124, and resistor 128 and diode 130, respectively.

The DC voltage is also coupled through conductors 113 and 117 to a comparator 118. The comparator is also connected to ground potential through conductors 133 and 131. The anode of diode 130 is connected as one input to comparator 118 through conductor 132, while the other input to comparator 118 is connected by conductor 125 to the junction of resistors 120 and 122 at conductor 121. The spaced apart diodes 124 and 130 are spaced adjacent evaporator coil 14 on the downstream side from an air moving means, such as a fan or blower 60 (see FIG. 3), which moves air through evaporator 14 in the direction shown. Diode 130 is located closest to coil 14 and diode 124 spaced further away to receive the cold air flow leaving evaporator 14 (shown at 62 in FIGS. 3 and 6). Heater 46 is physically located in the air flow path between the spaced diodes 124 and 130.

In operation, the diodes 130 and 124, along with their bias resistors 128 and 120, respectively, function as temperature responsive means and sense the relative temperature of the airstream 62 at their respective locations. As the temperature increases, the voltage across the diodes 124 and 130 decreases. Resistor 122 functions to establish a preselected voltage in series with the voltage appearing at diode 124. Since the temperature at diode 124 will generally be higher than the temperature at diode 130 (diode 124 is further away from coil 14 in the airflow path and the air is heated by heater 46 prior to reaching diode 124), the voltage at the anode of diode 124 will also be lower than the voltage at the anode of diode 130. However, the voltage level established by resistor 122 is added to the voltage at the anode of diode 124 to establish a larger combined voltage level appearing on conductor 125 to establish a preselected voltage differential which is applied to comparator 118. The input from conductor 125 (diode 124) is the "high" input, and the input from conductor 132 (diode 130) is the "low" input to comparator 118.

When there is no frost or very little frost on evaporator 14, then the cold airflow at 62 will have its maximum velocity through the evaporator 14 and across the diodes 124 and 130. At the maximum velocity, substantially the only voltage differential between diodes 124 and 130 will be due to the voltage difference established by resistor 122 since the thermal heating of heater 46 is limited to a rate that is less than the cooling rate of the moving cold air. As long as the diode 124 input to comparator 118 is higher than the diode 130 input, comparator 118 will generate an output that causes SCR **49*b* to conduct and energize the heater 46**.

However, as the frost thickness on evaporator 14 (see FIGS. 1 and 2), increases the air velocity therethrough decreases and the temperature differential between diodes 124 and 130 increases due to the increased heating effect of heater coil 46 on the air reaching diode 124. As the temperature differential increases, the voltage at the anode of diode 124 goes more negative with respect to the anode of diode 130 until such time as the "high" voltage input to comparator 118 from the voltage divider network (resistors 120 and 122) falls below the "low" voltage input from the anode of diode 130. When the diode 124 input falls below the diode 130 input, the comparator output ceases and SCR **49*b* stops conducting, thus "turning off" the heater 46. With heater 46 de-energized, the thermostatic switch 40 rapidly cools to its "low" temperature condition and closes contacts 44 to energize the defrost means 26. When coil 14 is defrosted and a large volume of cold air once again flows over diodes 124 and 130, the temperature differential between the diodes decreases until the diode 124 voltage applied from the voltage divider resistors 120, 121 exceeds the diode 130 voltage applied to comparator 118, thus generating a comparator output applied to SCR 49*b*, causing the SCR to conduct and energize heating means 46**.

Referring now to FIGS. 3, 4, 5 and 6, any combination of optical, timer or air velocity defrost initiation devices 48, **48*a* or 48*b* may be utilized. For instance, the timer 48*a* and optical 48 devices may be connected in parallel by interconnecting leads 52' and 52 and 35' and 35, respectively. Similarly, timer 48*a* and air velocity 48*b* devices may be connected in parallel by interconnecting leads 52' and 52'' and 35' and 35'', respectively. For maximum reliability, all three circuits should be connected in parallel by joining leads 52, 52' and 52'', and 35, 35' and 35'', of optical 48, timer 48*a* and air velocity 48*b*** devices, respectively.

Numerous variations and modifications may be made in the structures herein described without departing from the present invention. Accordingly, it should be clearly understood that the forms of the invention herein described and shown in the figures of the accompanying drawings are illustrative only and are not intended to limit the scope of the invention.

I claim:

1. An evaporator defrost control for use in a refrigeration system including a refrigerating fluid compressor, a condenser, an evaporator, and an evaporator defrost means, the control comprising:

defrost initiating means operable independently of absolute temperature for requiring defrost of the evaporator, defrost terminating means positioned in a heat transfer relationship to the evaporator and responsive to the temperature thereof, said means responsive to a preselected high temperature level for energizing the compressor for cooling the evaporator and terminating defrost, said defrost termination means further responsive to a preselected low temperature level for de-energizing the compressor and energizing the evaporator defrost means, and heating means positioned in heat transfer proximity to said defrost terminating means and responsive to said defrost initiating means for heating said defrost terminating means above said preselected low temperature level, said heating means being de-energized by said defrost initiating means when a defrost is required for permitting said defrost terminating means to cool below said preselected low temperature level for energizing the evaporator defrost means and de-energizing the compressor, the evaporator defrost means heating the evaporator to a temperature above said pre-selected high temperature level for causing said defrost terminating means to respond and re-energize the compressor and de-energize the evaporator defrost means.

2. The apparatus as described in claim 1, wherein said defrost terminating means comprises a thermostatically controlled switch having at least a pair of switch contacts, at least one of said switch contacts being in a normally closed condition when said switch is maintained above said low temperature level by said heating means for energizing the compressor, and at least one of said switch contacts being in a normally closed condition when said switch is operable in response to said low temperature level for energizing the evaporator defrost means.

3. The apparatus as described in claim 2, wherein said pair of thermostatically controlled switch contacts comprises a single-pole double-throw thermostat.

4. The apparatus as described in claim 1, wherein said defrost initiating means comprises an optical frost sensing means.

5. The apparatus as described in claim 1, wherein said defrost initiating means comprises an air velocity responsive means.

6. The apparatus as described in claim 1, wherein said defrost initiating means comprises a timing means.

7. The apparatus as described in claim 1, wherein said defrost initiating means comprises an optical frost sensing means and a timing means connected in electrical parallel for initiating defrost only upon positive operation of both said means.

8. The apparatus as described in claim 1, wherein said defrost initiating means comprises an air velocity responsive means and a timing means connected in electrical parallel for initiating defrost only upon positive operation of both said devices.

9. The apparatus as described in claims 4 or 7 wherein said optical frost sensing means comprises:

an emitter for generating electromagnetic radiation within a preselected wave length range directed at the frost on the evaporator, pulse circuit means cooperating with said emitter for periodically energizing said emitter for a preselected time interval for generating periodic pulses of said electromagnetic radiation, and electromagnetic radiation detecting means cooperating with said heating means for receiving said periodic pulses of electromagnetic radiation not absorbed or scattered by the frost on said coil, said detecting means conducting for energizing said heating means in response to receiving said electromagnetic radiation exceeding a predetermined intensity.

10. The apparatus as described in claim 5 or 8 wherein said air velocity responsive means comprises:

an airstream moving through the evaporator, first temperature responsive means located at a first location in the path of said airstream for generating a first voltage signal representative of the temperature of the air at said first location, second temperature responsive means located at a second location spaced from said first temperature responsive means downstream in the path of said airstream for generating a second voltage signal representative of the temperature of the air at said second location, voltage level establishing means for establishing a preselected voltge level, said means being disposed in an electrical series relationship with said second temperature responsive means for adding said preselected voltage level and said second voltage signal to form a third voltage signal representative of the sum of said voltages, said heating means being disposed between said first and second temperature responsive means for adding heat to said air prior to reaching said second temperature responsive means, and control means for receiving and comparing said first and third voltage signals and in response thereto energizing said heating means when said third voltage signal exceeds said first voltage signal.

11. The apparatus as described in claim 10, wherein said control means comprises:

a comparator for receiving said first and third voltage signals and generating an output voltage when said third voltage signal exceeds said first voltage signal, and an SCR receiving said output voltage from said comparator and conducting in response thereto for energizing said heating means.

12. The apparatus as claimed in claim 10, wherein said first and second temperature responsive means comprise temperature responsive diodes.

13. The apparatus as described in claim 6 or 7 or 8, wherein said timing means comprises:

timing means for generating an output voltage signal for a preselected time period, inhibiting means for inhibiting the generation of said timing means output signal when the refrigerator compressor motor is de-energized, and switching means receiving said timing means output signal and in response thereto energizing said heating means.

14. The apparatus as described in claim 13, wherein said timing means comprises:

a timer for establishing said preselected time period, and an oscillator for driving said timer through said preselected time period.

15. The apparatus as described in claim 14, wherein said switching means comprises an SCR receiving said timing means output signal and conducting in response thereto for energizing said heating means.

16. A refrigerator comprising:

an insulated housing means enclosing a refrigerated storage space, cooling means for cooling said refrigerated storage space comprising a refrigerating fluid compressor, a condenser, an evaporator disposed in said housing means and normally operated at temperatures below freezing, and an evaporator defrost means, defrost initiating means operable independently of absolute temperature for requiring defrost of the evaporator, defrost terminating means positioned in a heat transfer relationship to the evaporator and responsive to the temperature thereof, said means responsive to a preselected high temperature level for energizing the compressor for cooling the evaporator and terminating defrost, said defrost termination means further responsive to a preselected flow temperature level for de-energizing the compressor and energizing the evaporator defrost means, and heating means positioned in heat transfer proximity to said defrost terminating means and responsive to said defrost initiating means for heating said defrost terminating means above said preselected low temperature level, said heating means being de-energized by said defrost initiating means when a defrost is required for permitting said defrost terminating means to cool below said preselected low temperature level for energizing the evaporator defrost means and de-energizing the compressor, the evaporator defrost means heating the evaporator to a temperature above said pre-selected high temperature level for causing said defrost terminating means to respond and re-energize the compressor and said heating means and de-energize the evaporator defrost means.

17. The refrigerator as described in claim 16, wherein said defrost terminating means comprises a thermostatically controlled switch having at least a pair of switch contacts, at least one of said switch contacts being in a normally closed condition when said switch is maintained above said low temperature level by said heating means for energizing said compressor, and at least one of said switch contacts being in a normally closed condition when said switch is operable in response to said low temperature level for energizing said evaporator defrost means.

18. The refrigerator as described in claim 17, wherein said pair of thermostatically controlled switch contacts comprises a single-pole double-throw thermostat.

19. The apparatus as described in claim 16, wherein said defrost initiating means comprises an optical frost sensing means.

20. The apparatus as described in claim 1, wherein said defrost initiating means comprises an air velocity responsive means.

21. The apparatus as described in claim 16, wherein said defrost initiating means comprises a timing means.

22. The apparatus in accordance with claim 9, wherein said pulse circuit means for pulsing said emitter at preselected time intervals includes a disc in series with said emitter, and an RC network connected to said diac for receiving input current from an ac supply source that builds a charge for reverse biasing said diac, thereby discharging the capacitor of said RC network through said diac and creating pulse current through said emitter, thereby causing said emitter to conduct and removing the reverse bias from said diac to render said emitter non-conductive and allowing a subsequent charge to build up.

23. The apparatus in accordance with claim 22, wherein said electromagnetic radiation detecting means is a gated semiconductor device, and said pulse circuit means includes a resistor connected to said gating detecting means for establishing a predetermined threshold level therefor.

24. The apparatus in accordance with claim 23, wherein said electromagnetic radiation detecting means is a light admitting silicon controlled rectifier (LASCR), said threshold resistor being connected between the gate and the anode of said LASCR.

25. The apparatus as described in claim 19, wherein said optical front sensing means comprises:

an emitter for generating electromagnetic radiation within a preselected wave length range directed at the frost on the evaporator, pulse circuit means operating with said emitter for periodically energizing said emitter for a preselected time interval for generating periodic pulses of said electromagnetic radiation, and electromagnetic radiation detecting means cooperating with said heating means for receiving said periodic pulses of electromagnetic radiation not absorbed or scattered by the frost on said coil, said detecting means conducting for energizing said heating means in response to receiving said electromagnetic radiation exceeding a predetermined intensity.

26. The apparatus in accordance with claim 25, wherein said pulse circuit means for pulsing said emitter at preselected time intervals includes a diac in series with said emitter, and an RC network connected to said diac for receiving input current from an ac supply source that builds a charge for reverse biasing said diac, thereby discharging the capacitor of said RC network through said diac and creating pulse current through said emitter, thereby causing said emitter to conduct and removing the reverse bias from said diac to render said emitter non-conductive and allowing a subsequent charge to build up.

27. The apparatus in accordance with claim 26, wherein said electromagnetic radiation detecting means is a gated semiconductor device, and said pulse circuit means includes a resistor connected to said gated detecting means for establishing a predetermined threshold level therefor.

28. The apparatus in accordance with claim 27, wherein said electromagnetic radiation detection means is a light admitting silicon controlled rectifier (LASCR), said threshold resistor being connected between the gate and the anode of said LASCR.

* * * * *